United States Patent [19]

Schulz

[11] Patent Number: 4,706,873

[45] Date of Patent: Nov. 17, 1987

[54] DISPOSABLE CUP WITH SIDEWALL POP-OUT

[75] Inventor: Werner Schulz, Newtown, Conn.

[73] Assignee: James River-Norwalk, Inc., Norwalk, Conn.

[21] Appl. No.: 392,176

[22] Filed: Jun. 25, 1982

[51] Int. Cl.[4] ..... B65D 3/28

[52] U.S. Cl. ..... 229/1.5 B; 40/324; 206/459; 206/831

[58] Field of Search ..... 40/324, 306; 283/51, 283/52, 56, 103; 229/1.5 B, 1.5 C, 70, 3.1, 75; D7/6, 9; 206/459, 611, 613, 631

[56] References Cited

U.S. PATENT DOCUMENTS

| | | | |
|---|---|---|---|
| 2,186,940 | 1/1940 | Sullivan | 40/312 |
| 2,773,634 | 12/1956 | Negoro | 206/613 X |
| 3,207,417 | 9/1965 | Hennessey et al. | 206/613 X |
| 3,395,792 | 8/1968 | Larson | 206/459 |
| 3,580,483 | 5/1971 | Young | 206/631 X |
| 3,827,620 | 8/1974 | Ludder | 229/1.5 B |
| 3,850,361 | 11/1974 | Day et al. | 40/324 X |
| 4,171,085 | 10/1979 | Doty | 229/1.5 B |

*Primary Examiner*—George E. Lowrance
*Assistant Examiner*—Gary E. Elkins
*Attorney, Agent, or Firm*—William A. Aguele; Harry W. Hargis, III; Thomas H. Whaley

[57] ABSTRACT

A paper cup or similar disposable thin-walled fluid container with a removable or pop-out portion in its sidewall containing redemption information is disclosed wherein the pop-out portion is formed by a series of surrounding perforations in the sidewall, which perforations are sealed against fluid leakage by being filled with the protective material, such as wax, that is used to coat the sidewall to protect it against the fluid in the container. The perforations may outline an integral portion of the sidewall or when the redemption indicia is to be obscured, separate portions at the opposite edges of the sidewall blank may be outlined, which portions will cooperate to form the pop-out portion as part of the sidewall seam when the edges are overlapped and joined. In the latter instance, the perforations extend into the sidewall beyond the limits of the seam so that an opening will occur in the sidewall when the pop-out portion or a part thereof is removed to view the prize indicating indicia.

3 Claims, 8 Drawing Figures

Fig. 1.
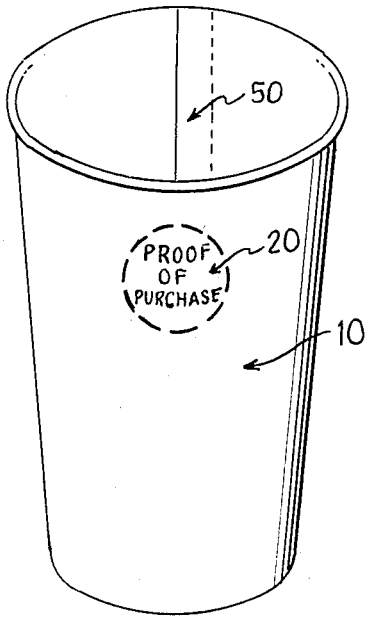
Fig. 3.
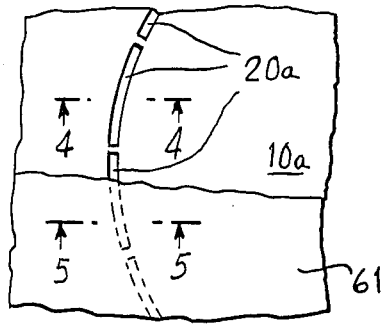
Fig. 4.
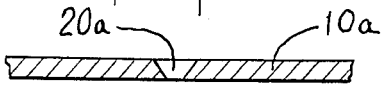
Fig. 5.
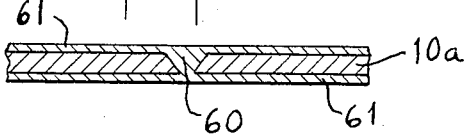
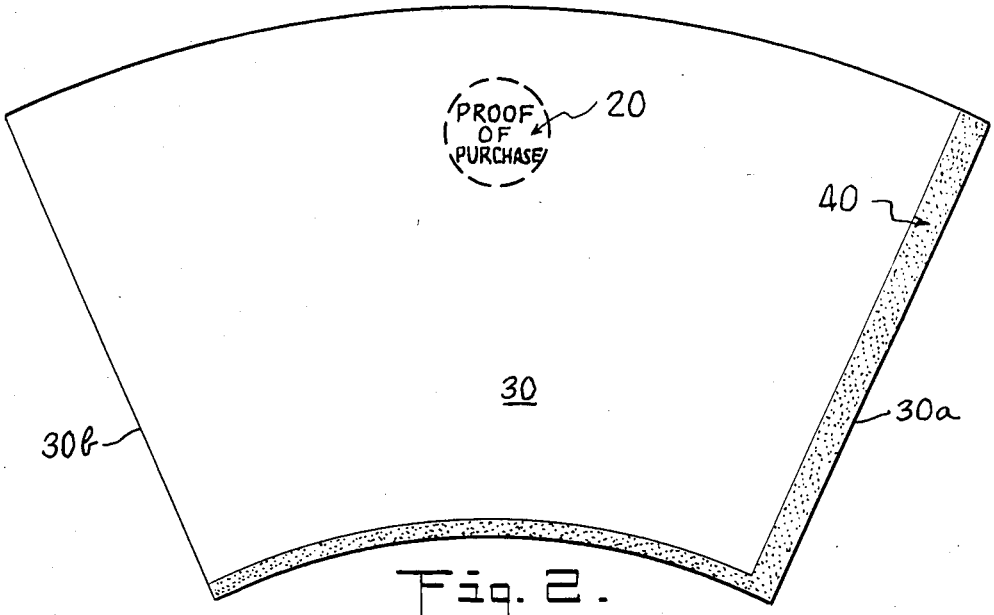
Fig. 2.

Fig. 6.
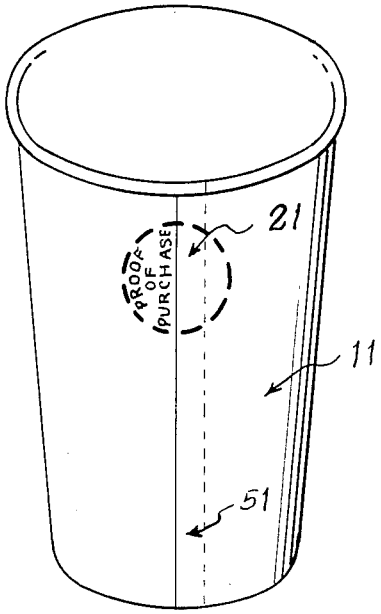
Fig. 8.
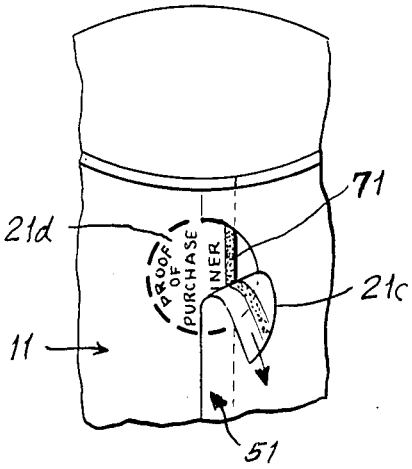
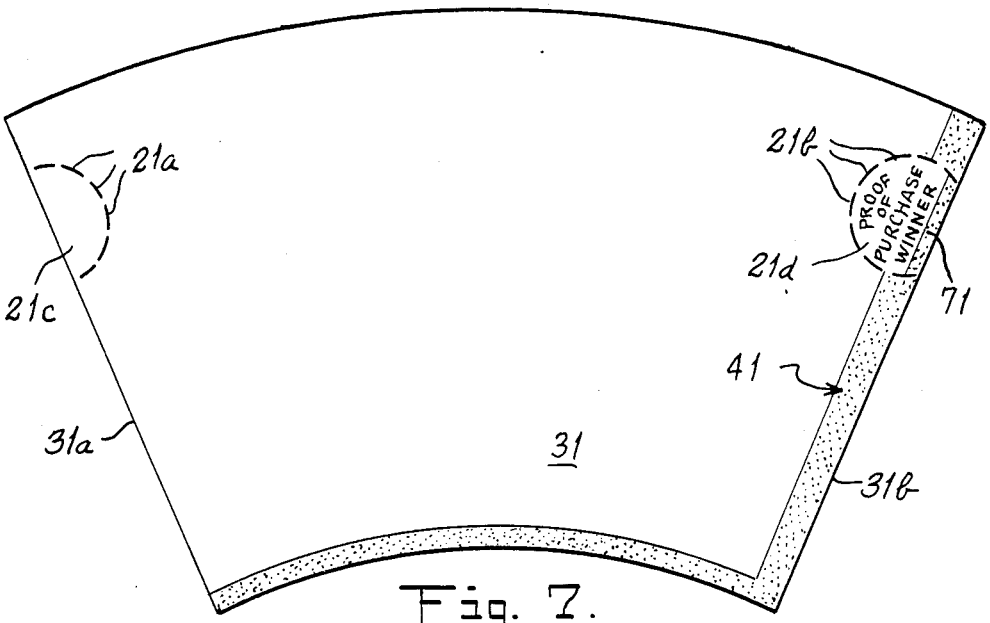
Fig. 7.

DISPOSABLE CUP WITH SIDEWALL POP-OUT

BACKGROUND OF THE INVENTION

The present invention relates to paper cups or similar disposable containers and more particularly to a cup construction incorporating a pop-out or tear-off portion containing premium or prize-winning indicia which renders the container unfit for reuse.

It has long been a problem in the disposable container art that the unscrupulous will recover cups and containers that have been previously used to dispense a product and refill them to pass them off as an original in some deceptive manner. For example, the problem is discussed in U.S. Pat. No. 2,186,940 to R. L. Sullivan in connection with lubricating oil cans bearing well known brand indicia that may be recovered and refilled with an inferior product and passed off to the public as the brand product. The solution of the problem as proposed in this patent is the formation of a score line preferably on the inside of the body wall of the container to facilitate the punching out of a portion of the wall by a consumer to render the container unusable and thus prevent its reuse. The consumer is induced to punch out the wall portion by the vendor of the product in some manner offering a premium in connection with the punchedout portion.

While scoring or weakening the sidewall of a can may be easily accomplished without significant danger of leakage of the contained product during storage or use, such a practice has been avoided in the paper cup or other thin-walled container art as evidenced by the disclosures, for example, in U.S. Pat. No. 3,827,620 to R. E. Ludder and U.S. Pat. No. 4,171,085 to W. T. Doty, wherein use-indicating tear-off tabs are provided in the overlapping seam portion of conventional beverage cups of paper or plastic rather than in the wall itself. Both of the disclosed inventions in these patents emphasize the problem of leakage when perforating the walls of such cups and the latter purports to improve upon the former in this regard.

Another approach to the use of a tear-off portion on paper cups is found in U.S. Pat. No. 3,850,361 to R. H. Day, et al., which discloses a double wall construction with a weakened line in a portion of the outer wall that can be detached from the cup for premium purposes.

The present invention is directed to solving the problem of the unscrupulous reuse of disposable cups and cartons for beverages and other fluids, in an improved and simplified manner as compared to those taught in the prior art.

SUMMARY OF THE INVENTION

The present invention involves a method and means of producing a paper cup or similar disposable container with a pop-out portion in is sidewall containing redemption information such as premium or prize-winning indicia, which portion may be readily removed to render the container unrefillable and thus prevent its reuse.

More particularly, during cup construction, the sidewall blank at the time it is printed with labeling and other indicia is accurately perforated using a rotary die in line with the printing operations, which perforations are sealed against the leakage of fluid from the completed container by filling with the material, such as wax, used during the protective coating operation. If it is desired to use the pop-out portion, which may be in the form of a circle, square or other suitable configuration with indicia printed thereon, for premium purposes, the perforations may be conveniently formed anywhere in the upper portion of the sidewall blank so that removal of the portion will form a fluid-passing opening in the sidewall. Alternatively, in the event that contest or prizewinning indicia, which must be obscured in some manner, is to be printed on the pop-out portion, the perforations may be formed cooperatingly in the opposite edges of the blank, which edges are brought together to form the sidewall seam during cup construction. One of the inner surfaces of the overlapping perforated edges may then be marked with the indicia so that it will be obscured from view within the seam. The perforations will extend into the sidewall in such manner that removal or peeling back of either of the edges to view the indicia will open the sidewall rendering the container unusable.

In either event, the portion with the premium or prize-winning indicia is readily removable from the container for redemption purposes obviating the need to retain the container or any other part thereof.

BRIEF DESCRIPTION OF THE DRAWINGS

FIG. 1 is a perspective view of a beverage cup incorporating the present invention.

FIG. 2 is a front plan view of a sidewall blank used in the construction of the beverage cup of FIG. 1.

FIG. 3 is an enlarged detail of a portion of the perforations in the sidewall of FIG. 2 showing a part coated with wax during construction of the cup.

FIG. 4 is a sectional view taken along the lines 4—4 in FIG. 3.

FIG. 5 is a sectional view taken along the lines 5—5 in FIG. 3.

FIG. 6 is a perspective view of a beverage cup illustrating a modification of the present invention.

FIG. 7 is a front plan view of a sidewall blank used in the construction of the beverage cup of FIG. 6.

FIG. 8 is an enlarged detail of a portion of the cup shown in FIG. 6 illustrating the utilization of the present invention.

DETAILED DESCRIPTION OF THE PREFERRED EMBODIMENT

FIG. 1 shows a typical disposable beverage cup of the type in which the present invention is readily incorporated and having a removable pop-out portion in its sidewall in accordance with the present invention. Such cups and other similar fluid-materials dispensing containers are typically constructed from blanks of paper, paperboard, plastic or other suitable thin-walled material, which blanks are joined together by a suitable sealing means such as glue. The cup shown in FIG. 1 is of the type that is normally used for dispensing such fluids as soft drinks and beer but which also may be found suitable for containing other fluid materials such as popcorn and ice cream. While the invention is particularly useful in connection with cups dispensing the former fluids, it may be used in connection with dispensing the latter fluid materials as well.

As seen in FIG. 1, the cup 10 is provided in its sidewall with a pop-out portion in the form of a proof of purchase coin 20. This coin 20 is of the type that may be used by a purchaser of the cup and its contents to obtain a premium of some form from the vendor of the product in one of many manners commonly practiced in the art. Of importance to the vendor is the fact that once the coin is removed, the cup can no longer be used for holding the fluid and particularly cannot be refilled once used and thus is not susceptible to misuse. Containers of this type may be constructed in accordance with the present invention in the following manner.

Firstly, the thin-walled stock 10*a* from which the various components of the container, such as the sidewall blank 30 shown in FIG. 2, are to be formed is subjected to a conventional printing operation during which indicia regarding the fluid materials to be held in the container and other information are printed thereon. The printed information may include an identification of the portion of the wall which will constitute a proof of purchase coin or other pop-out form and instructions for the removal thereof. Also, the inner surface of the blank in the portion opposite the proof of purchase coin 20 may be marked with a supervariegated form of indicia that when printed over a series of blanks will spell a particular word or make up a number series that can be used by the dispenser to promote sales of the contained product by offering a new product, a trade-up on an existing product, or some other form of premium.

During the printing operation, a rotary die is used to make perforations in the blank 30 by weakening or cutting through the stock in a series of locations that will surround the portion containing the proof of purchase indicia. The series of perforations may be in the form of a circle such as shown partly in FIG. 3, a square, a rectangle, a diamond, a star-shape or any other suitable configuration. Irrespective of their configuration, the series of perforations 20*a* will cooperate with each other to allow the portion lying within them to be removed by being pushed, popped, punched out or peeled from the surrounding stock upon the application of a directed pressure.

After the printing and perforation operations are completed, blanks of the container's component parts to be assembled are cut from the stock 10*a* into the form of the various components such as sidewall blank 30. A suitable glue 40 or other fastening material may be applied along one or more edges of the sidewall blank 30 so that a container may be constructed by joining the sidewall to a suitable bottom member and forming a sealing seam 50 by attaching the glued edge 30*a* to the opposite edge 30*b* of the sidewall blank 30 in a manner familiar to those skilled in the art.

At this stage of the construction, it would normally be expected that the perforations 20*a* in the side-wall would render it susceptible to leakage of any fluid with which the container 10 might be filled particularly if the perforations 20*a* pass completely through the sidewall and open into the interior of the container as shown in the section in FIG. 4. However, in accordance with the present invention, if the perforations 20*a* are carefully and accurately formed, such as by a rotary die in preference to a steel-ruled die, a minimum opening will occur at the apex of the V-shaped perforation 20*a* and the entire perforation may be sealed by taking advantage of the protective coating which may then be applied as a layer over the thin-walled stock to resist any deleterious effect the contained fluid might have in directly engaging the stock material. It has been found that by using a rotary die in line with the printing operation that will form accurate perforations in the stock, sufficient protective material 60, such as wax, may be accepted in the perforations 20*a* in forming the integral protective layer 61 and thus will provide a perfect seal in the perforated areas of the wall such as shown in FIG. 5. The protective material 60 selected for this purpose, such as wax or other suitable plastic material, should be capable of forming a barrier in each perforation 20*a* against the passage of the fluid while at the same time being readily yieldable to the application of concentrated pressure. Special materials are not required, various commercially obtainable waxes conventionally used in coating such containers having been found suitable for this purpose.

It will be appreciated that the perforated portion 20 is preferably formed in the upper part of the container 10 near the top to minimize the pressure from the fluid in a filled container acting thereon.

The cups or containers so constructed are then ready to be filled with any suitable fluid to be dispensed without any leakage of the fluid during normal handling and use. Once the container has been used or even before use, the proof of purchase coin portion 20 may be readily removed from the sidewall by applying a concentrated pressure thereon, thus destroying the usefulness of the cup 10 as a container for fluids. This feature prevents unscrupulous refilling or reuse of the container 10 and the removal of the proof of purchase coin 20 by the consumer of the originally contained fluid product may be induced, as previously noted, by offering some premium or advantage in connection therewith.

It will be seen that in the embodiment of the invention just described, the premium or other indicia on the proof of purchase coin 20 may be viewed by a user without necessarily removing the coin from the sidewall of the container 10. This feature could be undesirable if the indicia is to be used to indicate a prize since a user might readily determine whether or not the pop-out portion could be used as a winner and thus non-winning indicia would deter the user from popping or punching out the coin 20. To overcome this disadvantage, a modified embodiment of the invention is illustrated in FIGS. 6–8.

As shown in FIG. 6, in this modified embodiment a removable portion 21 may be formed in the seam 51 of the cup 11. This may be accomplished again during the printing operations by using a rotary die to form perforations 21*a* and 21*b*, respectively on the opposite edges 31*a* and 31*b* of the sidewall blank 31 as seen in FIG. 7. The configuration of each set of perforations 21*a* and 21*b* may be such that they cooperate to enclose a portion of the sidewall at the seam 51 when the respective edges 31*a* and 31*b* are brought together and joined by glue 41 during construction.

Prize-winning indicia may be printed on the backside of the perforated portion 21*c* on edge 31*a* or the front side of the perforated portion 21*d* on edge 31*b* as viewed in FIG. 7, wherein the indicia 71 is marked on the portion 21*d*. In this manner, the indicia 71 will be obscured from view within the seam 51 when the container is formed. Consequently, it will be necessary to pop out the entire portion 21, or to at least peel back the overlying perforated portion 21*c* as shown in FIG. 8, in order to view the prize-indicating indicia 71. In either event, the respective sets of perforations 21*a* and 21*b* will be formed so as to extend an ample distance from the edges 31*a* and 31*b* into the sidewall beyond the limits of the edge portions forming the seam 51 so that an opening will occur in the sidewall of the constructed cup 11 when a sufficient amount of the perforated portion is removed to view the prize-indicating indicia 71. Thus it will be necessary to destroy the usefulness of the cup 11 as a fluid container by creating an opening in its sidewall through which any fluid placed therein may escape, in order to be able to determine whether indicia 71 indicates the winning of a prize.

It may be found desirable in connection with this embodiment during the printing operation to cover at least a part of the area of, for example, the peel-off portion 21*c* with a diagonal print or other obscuring indicia to prevent see-through reading of the prize-winning indicia 71 within the seam 51 by holding the container 11 up to a light or other non-destructive viewing means. Of course the area containing the prize-winning indicia will normally be avoided when subsequently applying the layer of glue during container assembly.

It will accordingly be seen that the present invention provides an improved, effective, and simple solution to the problem of the unscrupulous reuse of disposable cups and containers for dispensing fluids, by creating a pop-out portion in the sidewall of such containers using a series of weakening perforations and sealing the perforations against fluid leakage by means of the material used to form a protective layer over the sidewall stock. The removed sidewall portion facilitates the redemption procedure as the container need not be retained for this purpose as required by prior art systems. Also the invention may be accomplished using conventional thin-walled container stock and coating materials, and convenient manufacturing procedures.

What is claimed is:

1. A disposable paperboard cup for dispensing liquids, said cup having a tapered sidewall with a lapped side seam and a rolled rim wherein said side seam includes a bonded area within the boundaries of the overlapping parts of said sidewall and wherein protions of the surface of said sidewall are hidden from view by the curled rim and by said overlapping portions of the sidewall, which comprises:

a first line of weakness in said sidewall defining a first removable portion bounded along one side by an overlapping portion of said sidewall and covering a hidden message or indicia; and a second line of weakness defining a second removable portion bounded on one side by the overlapped portion of said sidewall and bonded thereto to form a seam such that said first and second removable portions cooperate to define a removable medallion including a part of said seam;

said lines of weakness comprising a series of slits or perforations extending through said sidewall; and a liquid impermeable protective coating on said sidewall rendering said sidewall and said lines of weakness liquid tight and preventing leakage therethrough until said line of weakness is broken.

2. A disposable paperboard cup as defined in claim 1, wherein said removable portions are located adjacent the rim of said container.

3. A paperboard cup as defined in claim 1 wherein upon removal of said removable portion from said sidewall of the cup a part of the surface of the sidewall containing said message or indicia normally hidden from view is revealed.

* * * * *